US007548629B1

(12) United States Patent
Griffin

(10) Patent No.: US 7,548,629 B1
(45) Date of Patent: Jun. 16, 2009

(54) EARPIECE ADAPTER FOR AN EARPHONE OR A HEADPHONE

(75) Inventor: Paul Griffin, Nashville, TN (US)

(73) Assignee: Griffin Technology Inc., Nashville, TN (US)

( * ) Notice: Subject to any disclaimer, the term of this patent is extended or adjusted under 35 U.S.C. 154(b) by 572 days.

(21) Appl. No.: 11/075,080

(22) Filed: Mar. 8, 2005

(51) Int. Cl.
*H04R 25/00* (2006.01)

(52) U.S. Cl. ..... 381/382; 381/380

(58) Field of Classification Search ..... 381/150, 381/151, 182, 189, 370, 371, 373, 374
See application file for complete search history.

(56) References Cited

U.S. PATENT DOCUMENTS 3,415,246 A * 12/1968 Hill ..... 128/864
6,292,565 B1 * 9/2001 Chamberlin et al. ..... 379/452
6,411,722 B1 * 6/2002 Wolf ..... 381/371

FOREIGN PATENT DOCUMENTS

GB 2355129 A * 4/2001
GB 2376832 A * 12/2002

* cited by examiner

*Primary Examiner*—Suhan Ni
*Assistant Examiner*—Jasmine Pritchard
(74) *Attorney, Agent, or Firm*—Hornkohl Intellectual Property Law PLLC

(57) ABSTRACT

An adapter for connection to an earphone or headphone having a speaker which is housed in a relatively rigid casing utilizes an elongated hollow body having two open ends. One open end of the body is adapted to be positioned about the relatively rigid speaker casing of the earphone or headphone for connection thereto, and the other open end of the body is adapted to be positioned within the ear of a user. The hollow body has an interior shape which is shaped to conduct sound emitted from the speaker casing toward and through the other open end of the body.

17 Claims, 3 Drawing Sheets

EARPIECE ADAPTER FOR AN EARPHONE OR A HEADPHONE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

FIELD OF THE INVENTION

This invention relates generally to accessories for earphones and headphones and relates, more particularly, to an accessory for enhancing the use of an earphone or headphone.

BACKGROUND OF THE INVENTION

Earphones and headphones having speakers which are housed in relatively rigid casings and are adapted to be positioned against the ear of a user are well known in the prior art. Unfortunately, prior art earphones and headphones often slip off of a user's ear and are inefficient in transferring sound to the ear of the user. Therefore, it is an object of the present invention to provide a new and improved accessory for use with an earphone or headphone which improves the transmission of sound from the earphone or headphone to the ear of a user and decreases the likelihood that the earphone or headphone will to move away from the ear of the user. A further object of the present invention is to provide such an accessory, or adapter, which is uncomplicated in structure, yet effective in operation.

BRIEF SUMMARY OF THE INVENTION

An embodiment of the present invention is directed toward adapter for connection to an earphone or headphone having a speaker which is housed in a relatively rigid casing. The adapter includes an elongated hollow body having two open ends that is constructed of a resilient material. One open end of the body is adapted to be positioned about the relatively rigid speaker casing of the earphone or headphone for connection thereto. The relatively rigid casing of the earphone or headphone with which the adapter is to be used is preferably substantially circular in cross section, and the open end of the adapter body is adapted to tightly accept the relatively rigid casing of the earphone or headphone urged therein so that upon urging the relatively rigid casing into the one open end, the adapter is connected to the relatively rigid casing by a tight-fitting relationship there between. Alternatively, the relatively rigid casing is bulbous in form and the diameter of the peripheral edge is slightly smaller than the largest diameter of the bulbous form of the relatively rigid casing so that when the relatively rigid casing is urged into the open end, the peripheral edge is forced to slightly expand to accommodate the passage of the bulbous form of the relatively rigid casing. In an alternative embodiment, one open end of the adapter body has a peripheral edge which substantially encircles the relatively rigid casing when positioned thereabout. The peripheral edge has a plurality of notches formed therein to accommodate a slight expansion of the peripheral edge when the relatively rigid casing is urged into the one open end to connect the adapter to the relatively rigid casing. Most preferably, there are four notches which are regularly spaced about the peripheral edge of the one open end.

The other open end of the adapter body is adapted to be positioned within the ear of a user. This end of the adapter includes an earpiece tip of relatively soft material which is secured about the end for enhancing a wearer's comfort when the end is positioned within the ear of a user. The hollow body has an interior shape which conducts sound emitted from the speaker casing toward and through the other open end of the body. More particularly, the interior of the hollow body is shaped so that sound which enters the interior of the hollow body through the one open end is funneled toward and through the other open end. The interior of the hollow body preferably has a cross section which is substantially circular and the substantially circular cross section is reduced in size as a path is traced from the one open end to the other open end.

DETAILED DESCRIPTION OF THE INVENTION

Figure 1:
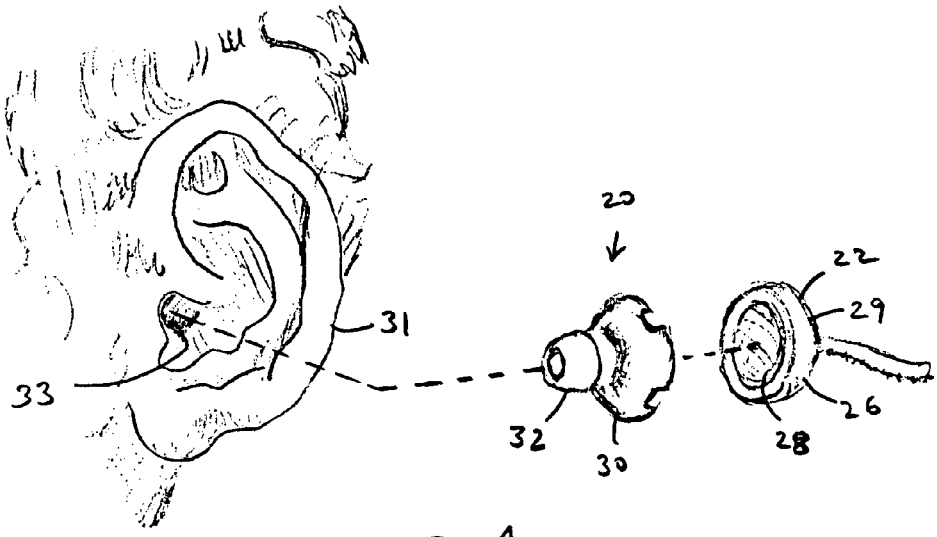
FIG. 1 is a perspective view of an embodiment of an adapter, a portion of an earphone with which the adapter is adapted to be used and an ear within which one end of the adapter is adapted to be positioned.

Referring now to FIG. 1, an adapter 20 constructed in accordance with an embodiment of the present invention is shown along with an earphone 22 of the type with which the adapter 20 is intended to be used. The earphone 22 includes a speaker having conventional sound-generating components which are housed in a relatively rigid casing 26 having an end 28 through which sound is emitted from the speaker. The speaker casing 26 of the depicted earphone 22 is circular in cross section and has a bulbous-shaped body 29 having a larger end which corresponds with the casing end 28 through which sound is emitted from the earphone 22. The casing 26 can be constructed (e.g. molded) out of a relatively hard plastic or other appropriate material.

During use, the earphone 22 is positioned adjacent an ear 31 of a user so that the sound-emitting end 28 of the earphone casing 26 is disposed near and directed toward the opening of the user's ear canal 33. In accordance with present invention as described in greater detail herein, the adapter 20 is connectable to the earphone casing 26 and is adapted to be positioned within the user's ear canal 33 to conduct sound which is emitted out of the end 28 of the earphone casing 26 directly into the user's ear canal 33.

Figure 2:
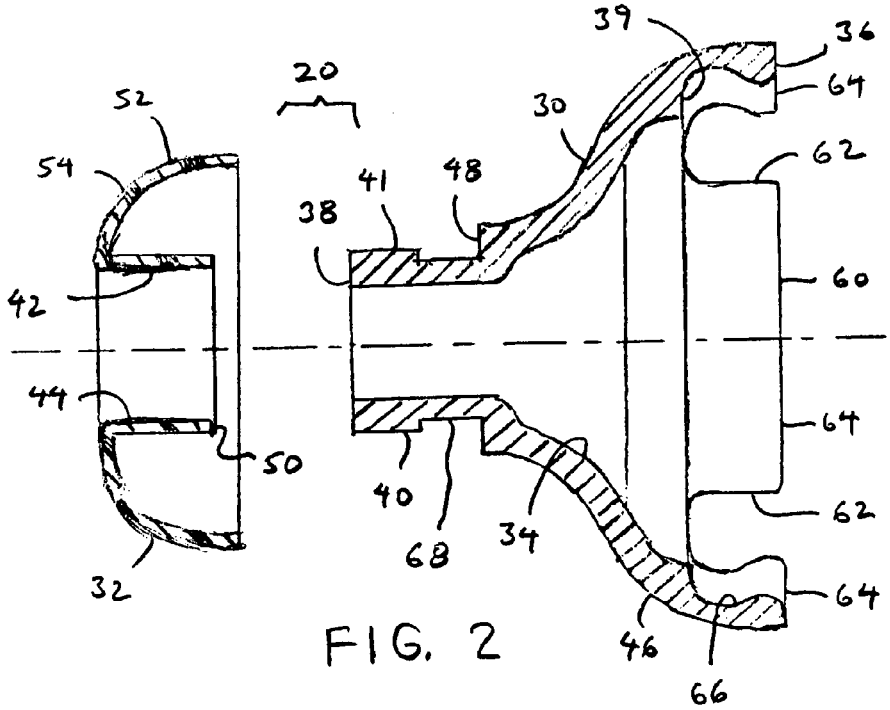
FIG. 2 is a longitudinal, cross-sectional view of the adapter shown in FIG. 1.

Referring now to FIG. 2, the adapter 20 includes an elongated hollow body 30 which is connectable about the casing 26 of the earphone 22 adjacent the end 28 thereof and an earpiece tip 32 which is connected to the hollow body 30 to enhance the wearer comfort of the adapter 20 when the hollow body 30 is positioned within the user's ear canal. The hollow body 30 of the adapter 20 includes a funnel-shaped section 46 and a cylindrically-shaped section 40 which may be formed together as a unitary structure. The body 30 further includes a smooth-surfaced interior 34 which opens out of the body 30 at opposite ends 36, 38 thereof. The open end 36 is adapted to receive the sound-emitting end 28 of the earphone casing 26 when the adapter 20 is connected thereto. The opposite end 38 of the adapter body 30 is adapted to be positioned within the user's ear canal 33.

Figure 3:
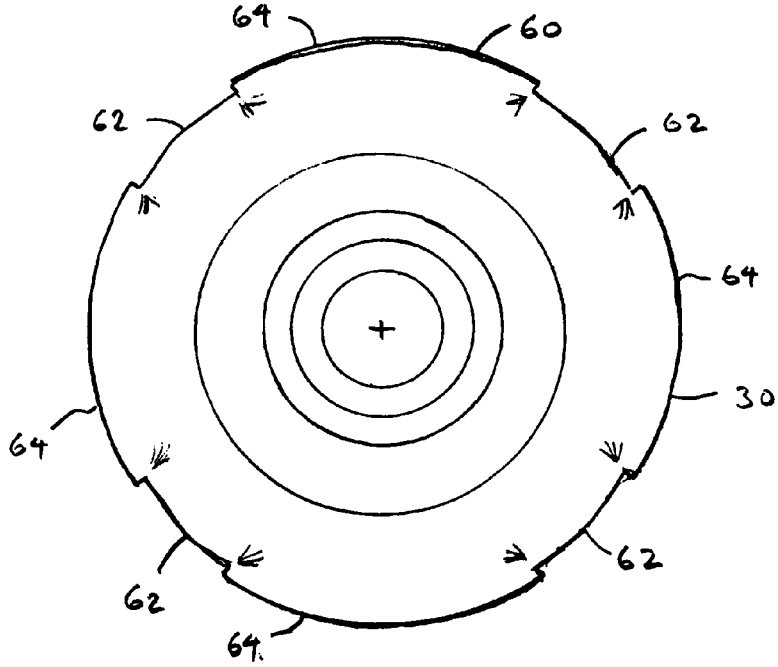
FIG. 3 is an end view of the adapter shown in FIGS. 1 and 2.

Referring now to FIG. 3, any radial cross section taken across the interior 34 of the adapter 20 is approximately circular in shape and its diameter gradually decreases (as best seen in FIG. 2) as a path is traced from one open end 36 of the body 30 to the other open end 38. During use of the adapter 20, the sound which is emitted out of the earphone casing end 28 is conducted from the open end 36 of the adapter body 30 to and through the opposing open end 38 of the adapter body 30. The conductance of the sound from the open end 36 to the open end 38 is basically a funneling action which channels the sound waves from the open end 36 to the open end 38 to thereby increase the perceived amplitude of the sound signal, as well as the amplitude of some frequencies of the sound waves at the open end 38. Another beneficial consequence of this funneling action is that the sound pressure level (SPL) is increased within the adapter body 30 as a path is traced from the open end 36 to the open end 38 thereof. Thus, the funneling of the sound through the adapter body 30 enhances the sound emitted from the open end 38 so that the quality of sound heard by the user through the adapter body 30 is better than that heard directly from the casing end 28 without the aid of the adapter 20. The interior 34 of the adapter body 30 also defines an abutment surface 39 adjacent the open end 36.

Figure 4:
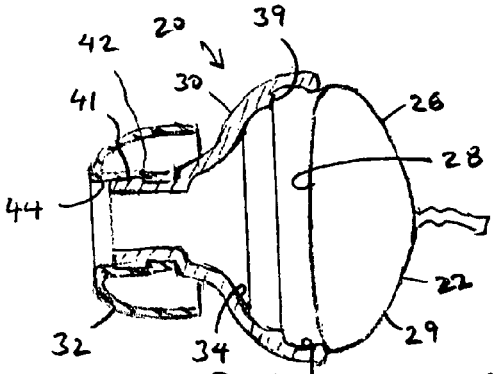
FIGS. 4-6 are perspective views showing the sequential steps involved in connecting the adapter of FIG. 1 to an earphone.
Figure 5:
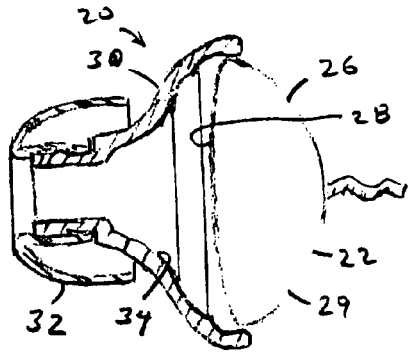
Figure 6:
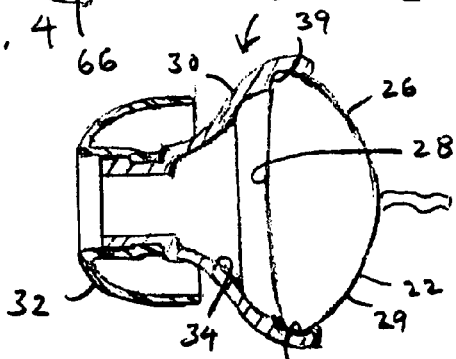

Referring back to FIG. 2, the cylindrically-shaped section 40 includes a smooth outer surface 41, and the earpiece tip 32 is snugly positioned about this outer surface 41 in the manner illustrated in FIGS. 4-6 to thereby secure the tip 32 and adapter body 30 together. In this connection, the earpiece tip 32 is formed as a unitary structure and includes a thin-walled inner portion 42 having a central through-opening 44 having a diameter which is slightly smaller than the largest diameter of the cylindrically-shaped section 40 so that when positioned thereabout, the inner portion 42 is in a slightly stretched (e.g. expanded) condition.

The cylindrically-shaped section 40 of the adapter body 30 is joined to the funnel section 46 of the body 30 at a shoulder 48. The surface of this shoulder 48 provides an abutment surface against which one edge, indicated 50, of the inner portion 42 is adapted to abut when the inner portion 42 is positioned about the cylindrically-shaped section 40. In other words, to join the earpiece tip 32 to the adapter body 30, the earpiece tip 32 is directed, edge 50 end first, over the open end 38 of the adapter body 30 until the edge 50 abuts the surface of the adapter body shoulder 48. A region 68 of reduced diameter is provided along the outer surface 41 of the cylindrical section 40 so that when it is stretched thereabout, the earpiece tip 32 resists inadvertent removal from the cylindrical section 40.

The earpiece tip 32 further includes a thin-walled outer portion 52 which is joined to the inner portion 42 along an edge thereof opposite the edge 50 and extends back over, so as to encircle, the inner portion 42. The outer portion 52 has an outer surface 54 which is rounded in shape and increases in diameter as a path is traced from the end to which the inner portion 42 is joined. This rounded shape of the outer portion 52 facilities the insertion of the adapter end 38 into the user's ear canal 33 as shown in FIG. 1. Furthermore, the material out of which the earpiece tip 32 is formed is relatively soft to enhance the comfort of the user when the adapter 20 is positioned within the user's ear. The material out of which the earpiece tip 32 of the depicted adapter 20 is constructed is preferably a soft rubber material, but other suitable materials can be used.

With reference to FIGS. 2-6, it is a feature of the adapter 20 that it fits snugly about the sound-emitting end 28 of the earphone casing 26 when connected thereto. Accordingly, the open end 36 of the adapter body 30 includes a peripheral edge 60 which extends around the open end 36 and includes a plurality of (e.g. four) notches 62 therein. Each of these notches 62 is substantially square in shape (with relatively straight side and bottom edges), and each adjacent pair of notches 62 separates the region of the funnel portion 46 adjacent the open end 36 into four equally-sized resilient segment sections 64. The resiliency of these segment sections 64 permits the segment sections 64 to be flexed from a relaxed condition (as illustrated in FIGS. 2 and 4) to an expanded condition (as illustrated in FIG. 5) to enable the adapter body 30 to be positioned about the sound-emitting casing end 28 of the earphone casing 26 for securement thereto.

To position the adapter 20 about the earphone 22, the open end 36 of the adapter body 30 is initially positioned against (and in registry with) the surface of the casing end 28 as is illustrated in FIG. 4. The outer (i.e. largest) diameter of the bulbous-shaped casing body 29 is slightly smaller than the outer diameter of the adapter body 30 at the open end 36. The adapter body 30 is then directed (e.g. forced) endwide against the surface of the casing body 29 so that the segment sections 64 (and the adjacent segments of the peripheral edge 60) are forcibly flexed outwardly toward the condition illustrated in FIG. 5 and the segments of the peripheral edge 60 are slidably moved along the surface of the casing body 29. The inherent resiliency of the material of the adapter body 30, as well as the flexibility provided by the notches 62, permits the outward flexing of the segment sections 64 and the resultant biasing of the segment sections 64 toward their normal relaxed condition.

As the adapter body 30 continuous to be urged against (and over) the body 29 of the earphone casing 28 from the depicted FIG. 5 condition in which the segment sections 64 are flexed outwardly by a maximum amount, the segment sections 64 are permitted to return toward the relaxed condition as the peripheral edge 60 continues to slide along the surface of the casing body 29. When the abutment surface 39 provided along the surface of the body interior 34 is engaged by the end 28 of the casing body 29, the earphone casing 26 is fully accepted by the adapter body 30 and the segment sections 64 are closed about the casing body 29, as is illustrated in FIG. 6, to thereby connect the adapter 20 to the earphone 22. Furthermore, due to their inherent resiliency, the segment sections 64 are so tightly and snugly positioned about the end 28 of the casing body 29 that the likelihood that the adapter 20 can be inadvertently disconnected from the earphone casing 26 is relatively small.

The section 66 shown in FIG. 2 of the body interior 34 which engages the outer surface of the sound-emitting end 28 of the earphone casing 26 when the casing 29 is fully inserted within the open end 36 of the adapter 22 (as illustrated in FIG. 6) is shaped substantially complementary to that of the section of the casing 29 about which the adapter 22 is positioned. This shaping of the section 66 of the body interior 34 permits the casing end 28 to be closely nested within the end 36 of the adapter body 30 when the casing end 28 is positioned therein. Due to the prompt return of the segment sections 64 toward the relaxed condition when the casing body 29 is fully inserted within the open end 36 of the adapter body 30, the adapter 20 is connected to the casing body 29 in a snap-fit relationship.

It follows from the foregoing that an adapter 20 has been shown and described which is connectable at one end about the sound-emitting end 28 of an earphone casing 26 and which is adapted to be positioned (at the other end) within the ear canal of a user's ear to conduct sound which is emitted from the casing end 28 to and through the open end 38 of the adapter body 29. When this conducted sound reaches the ear of the user, the sound is enhanced.

Exemplary dimensions of the adapter 20 are as follows. The diameter of the open end 36 (in the relaxed, FIG. 2 condition) is about 17.2 mm, the outer diameter of the cylindrical section 40 is about 5 mm, the length of the adapter body 29 is about 12 mm, the width of each notch 64 is about 4 mm, and the depth of each notch 64 is about 2.5 mm. However, these dimensions are exemplary only and are not intended to limit the scope of the present invention.

Figure 7:
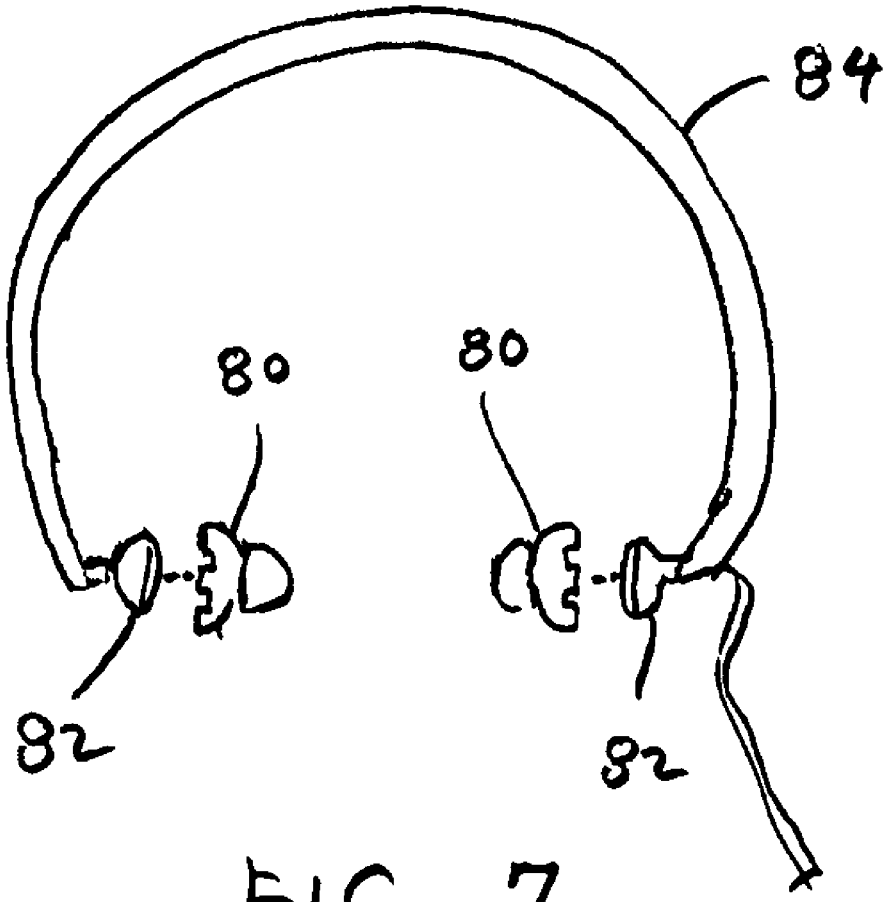
FIG. 7 is a front view of a set of headphones and a pair of adapters constructed in accordance with an embodiment of the present invention.

It will be understood by those skilled in the art that numerous modifications and substitutions can be made to the herein disclosed embodiment without departing from the spirit of the invention. For example, although the above describe embodiment 20 has been shown and described as being connectable about the casing of an earphone, it will be understood by those skilled in the art that an adapter embodying the features of the present invention is connectable to the speaker casing of a headphone, as well. For example, there is illustrated in FIG. 7 a pair of adapters 80, 80 which are each adapted to be fitted about the speaker casings 82, 82 of a headphone 84. Thus, the above described embodiments 20 are intended for the purpose of illustration only and are not intended to limit the scope of the present invention. Therefore, although there have been described particular embodiments of the present invention of a new and useful Earpiece Adapter for an Earphone or a Headphone, it is not intended that such references be construed as limitations upon the scope of this invention except as set forth in the following claims.

What is claimed is:

1. An adapter for connection to an earphone or headphone having a speaker which is housed in a relatively rigid casing and securing the earphone or headphone adjacent the ear of a user, the adapter comprising:

an elongated hollow body having two open ends, one open end of the body having a dome-shaped exterior and being adapted to be positioned about the relatively rigid speaker casing of the earphone or headphone for connection thereto and the other open end of the body being adapted to be positioned within the ear of a user wherein said hollow body has an interior shape which conducts sound emitted from the speaker casing toward and through said other open end of the body;

wherein the hollow body is constructed of a resilient material, and said one open end of the hollow body has a peripheral edge which substantially encircles the relatively rigid casing when positioned thereabout and said peripheral edge has a plurality of notches extending from said peripheral edge up said dome-shaped exterior formed therein to accommodate a slight expansion of said peripheral edge when said relatively rigid casing is urged into said one open end for connecting said adapter to said relatively rigid casing.

2. The adapter of claim 1 wherein the interior of the hollow body is shaped so that sound which enters the interior of the hollow body through said one open end is funneled toward and through said other open end.

3. The adapter of claim 2 wherein the interior of the hollow body has a cross section which is substantially circular and the substantially circular cross section is reduced in size as a path is traced from said one open end to said other open end.

4. The adapter of claim 1 wherein the relatively rigid casing of the earphone or headphone with which the adapter is to be used is substantially circular in cross section, and said one open end of the adapter body is adapted to tightly accept the relatively rigid casing of the earphone or headphone urged therein so that upon urging the relatively rigid casing into said one open end, the adapter is connected to the relatively rigid casing by a tight-fitting relationship there between.

5. The adapter of claim 1 wherein the relatively rigid casing is bulbous in form and the diameter of the peripheral edge is slightly smaller than the largest diameter of the bulbous form of the relatively rigid casing so that when the relatively rigid casing is urged into said open end, the peripheral edge is forced to slightly expand to accommodate the passage of the bulbous form of the relatively rigid casing.

6. The adapter of claim 1 wherein the plurality of notches is regularly spaced about the peripheral edge of said one open end.

7. The adapter of claim 1 wherein there are four notches which are regularly spaced about the peripheral edge of said one open end.

8. The adapter of claim 1 further comprising an earpiece tip of relatively soft material which is secured about said other open end for enhancing a wearer's comfort when said other end is positioned within the ear of a user.

9. An adapter for securing the speaker casing of an earphone or headphone adjacent the ear of a user, wherein the speaker casing of the earphone or headphone is relatively rigid, said adapter comprising:

an elongated hollow body having two open ends and interior walls which extend between the two open ends of the hollow body, one open end of the hollow body having a dome-shaped exterior and being adapted to be positioned about the relatively rigid speaker casing of the earphone or headphone for connection of the hollow body thereto and the other end of the hollow body being adapted to be positioned within the ear of a user, the opening at said other open end being smaller than the opening at said one open end so that the interior walls of the hollow body converge toward one another as a path is traced from said one end of the hollow body toward said other end of the hollow body so that when one end of the hollow body is positioned about the relatively rigid speaker casing of the earphone or headphone and sound is emitted from the speaker casing, the sound is conducted by the hollow body toward and through the smaller opening at said other end;

wherein the said one open end includes a plurality of resilient sections which are disposed about said open end of the hollow body and extend up said dome-shaped exterior which are movable relative to the remainder of the hollow body between a relaxed condition and an expanded condition such that the resilient sections are resiliently-biased toward the relaxed condition so that when said open end of the hollow body is urged about the relatively rigid speaker casing, the resilient sections of the open end are permitted to move between the expanded condition toward the relaxed condition to thereby secure said open end of the hollow body tightly about the relatively rigid casing.

10. The adapter of claim 9 wherein the relatively rigid casing of the speaker to which the adapter is connectable has a circular shape, and the hollow body includes a connection portion at said one open end thereof which is adapted to be positioned so as to substantially encircle the relatively rigid speaker casing when the adapter is connected thereto.

11. The adapter of claim 9 wherein said one open end has a peripheral edge thereabout and defines a plurality of notches around the peripheral edge and adjacent resilient sections are separated from one another by a corresponding one of the notches.

12. The adapter of claim 9 wherein the relatively rigid casing of the earphone or headphone with which the adapter is to be used is substantially circular in cross section, and said one open end of the adapter body is adapted to tightly accept the relatively rigid casing of the earphone or headphone urged therein so that upon urging the relatively rigid casing into said one open end, the adapter is connected to the relatively rigid casing by the tight-fitting relationship between said one open end and said relatively rigid casing.

13. The adapter of claim 12 wherein the adapter body is constructed of a resilient material and said one open end of the adapter body has a peripheral edge which substantially encircles the relatively rigid casing when positioned thereabout and the peripheral edge has a plurality of notches formed therein to accommodate a slight expansion of said peripheral edge when the relatively rigid casing is urged into said one open end for connecting the adapter to the relatively rigid casing.

14. The adapter of claim 13 wherein the plurality of notches is regularly spaced about the peripheral edge of said one open end.

15. The adapter of claim 9 further including an earpiece tip of relatively soft material which is secured about said other open end for enhancing wearer comfort when positioned within an ear of a user.

16. An adapter for securing the speaker casing of an earphone or headphone adjacent the ear of a user, wherein the speaker casing of the earphone or headphone is relatively rigid, said adapter comprising:

an elongated hollow body having two open ends and interior walls which extend between the two open ends of the hollow body, one open end of the hollow body having a dome-shaped exterior and being adapted to be positioned about the relatively rigid speaker casing of the earphone or headphone for connection of the hollow body thereto and the other end of the hollow body being adapted to be positioned within the ear of a user, the opening at said other open end being smaller than the opening at said one open end so that the interior walls of the hollow body converge toward one another as a path is traced from said one end of the hollow body toward said other end of the hollow body so that when one end of the hollow body is positioned about the relatively rigid speaker casing of the earphone or headphone and sound is emitted from the speaker casing, the sound is funneled through the hollow body from said one end toward and through the smaller opening at said other end;

a series of notches around a periphery of said one open end that extend up said dome-shaped exterior for securing said one open end to said relatively rigid speaker casing; and an earpiece tip of relatively soft material which is secured about said other open end for enhancing wearer comfort of said other end when positioned within the ear of a user, the earpiece tip having an opening which encircles said other open end of the adapter body.

17. The adapter of claim 16 wherein the interior of the hollow body has a section which is substantially circular in cross section and the substantially circular cross section is reduced in size as a path is traced from said one open end to said other open end.

* * * * *